United States Patent [19]

Fujii et al.

[11] Patent Number: 5,041,252

[45] Date of Patent: Aug. 20, 1991

[54] NONWOVEN FABRIC OF WATER-SOLUBLE RESIN FIBERS

[75] Inventors: Shigeo Fujii, Kawagoe; Shoichi Mori; Jyoichi Tabuchi, both of Iruma, all of Japan

[73] Assignee: Toa Nenryo Kogyo Kabushiki Kaisha, Tokyo, Japan

[21] Appl. No.: 396,836

[22] Filed: Aug. 22, 1989

Related U.S. Application Data

[63] Continuation of Ser. No. 170,635, Mar. 16, 1988, abandoned, which is a continuation of Ser. No. 776,028, Sep. 13, 1985, abandoned.

[30] Foreign Application Priority Data

Sep. 18, 1984 [JP] Japan ..... 59-193970
Sep. 19, 1984 [JP] Japan ..... 59-194796

[51] Int. Cl.[5] ..... B32B 9/00

[52] U.S. Cl. ..... 264/176.1; 264/165; 264/500; 264/555

[58] Field of Search ..... 428/332, 224, 338, 283, 428/401, 903; 604/364, 379; 264/165, 176.1, 500, 558

[56] References Cited

U.S. PATENT DOCUMENTS

| | | | |
|---|---|---|---|
| 4,092,454 | 5/1978 | Domojo et al. | 428/288 |
| 4,493,751 | 1/1985 | Cherdron et al. | 162/157.2 |
| 4,500,315 | 2/1985 | Pieniak et al. | 604/379 |
| 4,524,103 | 6/1985 | Seager | 428/338 |
| 4,537,590 | 8/1985 | Pieniak et al. | 604/379 |

FOREIGN PATENT DOCUMENTS

| | | |
|---|---|---|
| 0028565 | 2/1985 | Japan . |
| 1496017 | 12/1977 | United Kingdom . |

*Primary Examiner*—Patrick J. Ryan
*Attorney, Agent, or Firm*—Wenderoth, Lind & Ponack

[57] ABSTRACT

A nonwoven fabric consisting of water-soluble resin fine fibers having a mean fiber diameter of at most 30 μm and a basis weight of 5 to 500 g/m$^2$ is produced by extruding an aqueous solution containing a water-soluble resin or a melt of a water-soluble resin plasticized with water through nozzles, stretching the extruded material to form fibers by a high speed gas flow, heating the fibers to evaporate the water in the fibers and then collecting the fibers.

7 Claims, 1 Drawing Sheet

NONWOVEN FABRIC OF WATER-SOLUBLE RESIN FIBERS

This application is a division of now abandoned application Ser. No. 170,635, filed Mar. 16, 1988, abandoned, which application is, in turn, a continuation of application Ser. No. 776,028, filed Sep. 13, 1985, abandoned.

BACKGROUND OF THE INVENTION

1. Field of the Invention

This invention relates to a nonwoven fabric or cloth of a water-soluble resin such as pullulan and more particularly, it is concerned with a nonwoven fabric of water-soluble resin superfine fibers such as of pullulan and a process for the production of the same.

2. Description of the Prior Art

Edible and water-soluble high molecular weight materials, e.g. pullulan, have widely been used as foods, packaging materials or vessels of foods and films or fibers other than as foods. As to the fibers, above all, a process for producing pullulan fibers is known by Japanese Patent Publication No. 35165/1978, comprising extruding and spinning an aqueous solution of pullulan in a gaseous phase at a temperature of lower than 110° C. According to this process, however, it is impossible to produce a nonwoven fabric, in particular, consisting of superfine fibers of pullulan.

SUMMARY OF THE INVENTION

It is an object of the present invention to provide a nonwoven fabric or cloth of water-soluble superfine fibers.

It is another object of the present invention to provide a nonwoven fabric consisting of water-soluble pullulan superfine fibers which are hydrophilic, hygroscopic and free from electrification, and capable of being dissolved in not only warm water but also cold water.

It is a further object of the present invention to provide a process for the production of a nonwoven fabric consisting of water-soluble resin superfine fibers.

These objects can be attained by a nonwoven fabric consisting of water-soluble resin fibers having a mean fiber diameter of 30 μm or less, and having a basis weight of 5 to 500 g/m$^2$, and a process for the production of a nonwoven fabric or cloth, which comprises extruding an aqueous solution of pullulan or a melt of pullulan plasticized with water from a nozzle, stretching to form fibers by a high speed gaseous stream, heating the fibers to evaporate the water in the fibers and then collecting the fibers.

BRIEF DESCRIPTION OF THE DRAWINGS

The accompanying drawings are to illustrate the principle and merits of the invention in greater detail.

DETAILED DESCRIPTION OF THE INVENTION

Figure 1:
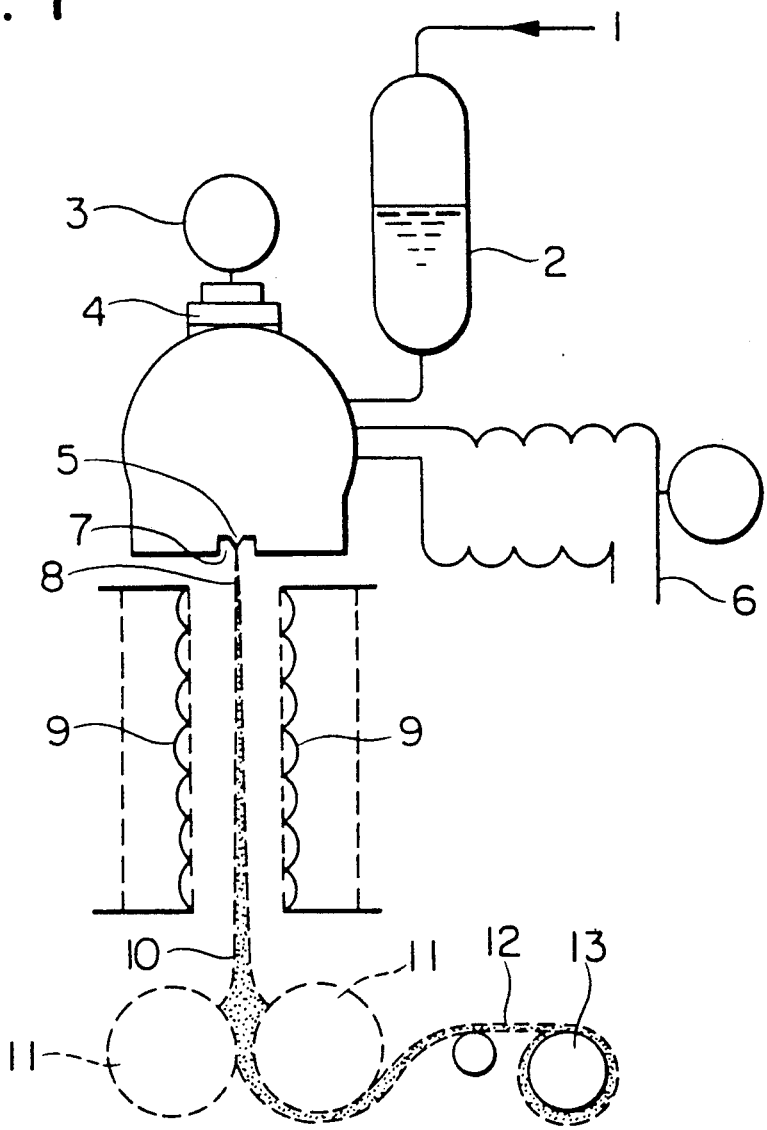
FIG. 1 is a schematic side view of one preferred embodiment of an apparatus for producting a nonwoven fabric according to the present invention.

The inventors have made various efforts to develop a nonwoven fabric or cloth consisting of water-soluble resin superfine fibers, which can be applied to various uses, and consequently, have succeeded in providing a nonwoven fabric consisting of water-soluble resin superfine fibers, in particular pullulan superfine fibers, having a mean fiber diameter of at most 30 λm, preferably 0.1 to 15 μm, more preferably 1 to 10 μm and a basis weight of 5 to 500 g/m$^2$, preferably 5 to 400 g/m$^2$, more preferably 10 to 300 g/m$^2$. Such a nonwoven fabric can be prepared by extruding an aqueous solution containing a water-soluble resin or a melt of a water-soluble resin plasticized with water through a nozzle, stretching to form fibers by a high speed gaseous stream, simultaneously heating the fiber stream to evaporate the water in the fibers and then collecting the fibers.

The water-soluble resins, which can generally be used in the present invention, are water-soluble linear high molecular materials having —OH, —COOH and —CONH$_2$ groups in the molecule, illustrative of which are pullulan that is a natural glucan wherein units of maltotriose corresponding to a trimer of glucose are repeatedly bonded through α-1, 6-linkages, which is elaborated by cultivating a black yeast *Aureobasidium pullulans* using decomposed products of starch or cane sugar under suitable conditions and has the molecular structure represented by the following formula, polyvinyl alcohol, polyacrylamide, polyacrylic acid, polymethacrylic acid, polyitaconic acid, polyethylene oxide, polyvinylpyrrolidone, polyvinyl methylene ether, hydroxypropyl cellulose, xanthan gum, guar gum, collagen, hydroxyethyl cellulose and the like.

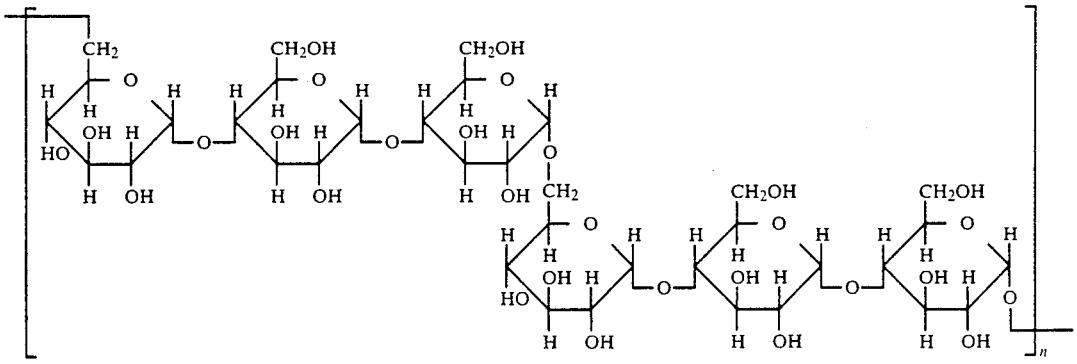

n: degree of polymerization.

The water-soluble resins used in the present invention are not limited by the processes for the production thereof, nor by the molecular weights thereof. In view of the strength and workability of a nonwoven fabric to be obtained, however, it is preferable to use those having a molecular weight of 2 to $200\times10^4$, more preferably 5 to $100\times10^4$.

These water-soluble resins can be used individually or in combination. In addition, these water-soluble resins can optionally be mixed with plasticizers or softeners, for example, water and polyhydric alcohols such as glycerol, sorbitol, maltitol, ethylene glycol and polypropylene glycol. For the purpose of improving the properties of the nonwoven fabric, moreover, there can be added thereto one or more inorganic materials such as apatite, silica, silicon carbide, silicon nitride, zeolite, activated carbon, alumina, rare earth element compounds and the like. In this case, for example, it is possible to obtain products similar to nonwoven fabric of inorganic fibers.

A water-soluble resin, as a raw material for the nonwoven fabric of the present invention, is dissolved in or plasticized with water at a temperature of 20° to 70° C., in particular, 20° to 35° C. in the case of pullulan, to prepare a starting liquid having a resin content of 5 to 95% by weight, preferably 10 to 40% by weight.

The starting liquid, i.e. aqueous solution containing a water-soluble resin such as pullulan or aqueous plasticized melt is extruded from a die consisting of a plurality of spinning nozzles each having small holes and being aligned in the width direction, while simultaneously a gas, e.g. air at a temperature of 20° to 60° C., in particular, 25° to 60° C. in the case of pullulan, is blown from around the nozzles at a linear velocity of 10 to 1000 m/sec against the extruded filaments to form a fiber stream consisting of stretched fine fibers. The diameters of the resulting fibers can be controlled to a suitable range, for example, 0.1 to 30 μm by varying the flow rate of this gas.

The fine fiber stream is heated to evaporate and remove the water in the fibers by means of a heater provided at a suitable interval beneath the die, for example, an infrared heater or microwave heater in such a manner that the water remains preferably in the fiber in a proportion of at most 10% by weight, particularly at most 8% by weight. If the removal of water is insufficient, a nonwoven fabric cannot be obtained, but only a highly viscous liquid is retained. The heating temperature of the fiber stream is preferably 80° to 120° C., depending on the quantity of the starting liquid extruded containing a water-soluble resin, the variety of a water-soluble resin, the balance of the temperature and pressure (flow rate) of a blown gas, etc. Raising the heating temperature to higher than required is not favourable because of resulting in decomposition of a water-soluble resin with a lower decomposition temperature, e.g. pullulan in addition to removal of the water.

The fine fiber stream, which has been subjected to stretching and removal of water, is entangled and allowed to fall on a collecting means, for example, a revolving drum or moving belt of net or perforated plate, thereby forming a nonwoven cloth. When the fine fiber stream is blown against and allowed to fall on the contact point of two collecting and revolving drums of net-type in the collection of the fiber stream, entangled fibers are arranged in the thickness direction of a nonwoven fabric to be obtained, i.e. three-dimensionally to form the bulky nonwoven fabric. On the other hand, when the fiber stream is blown against and allowed to fall on a part other than the contact point of the collecting drums or a collecting belt of flat plate type, there is obtained a nonwoven fabric wherein fibers are arranged in parallel with the plane, i.e. two-dimensionally. The basis weight of the nonwoven fabric can be controlled to a suitable range, for example, 5 to 500 g/m$^2$ by varying the moving rate of the above described collecting means of the fiber stream.

According to the process of the present invention as described above, a nonwoven fabric consisting of water-soluble resin superfine fibers, in particular, pullulan superfine fibers can at once be produced by blowing a high speed gaseous flow, i.e. air current against water-soluble resin fibers extruded to give a stretching ratio or magnification of 10 to 3000 times, preferably 20 to 1000 times and heating the fibers to evaporate rapidly the water in the fibers. This process gives readily a nonwoven fabric of water-soluble resin fibers with a mean fiber diameter of at most 30 μm, preferably 0.1 to 15 μm, more preferably 1 to 10 μm and a basis weight of 5 to 500 g/m$^2$, preferably 5 to 400 g/m$^2$, more preferably 10 to 300 g/m$^2$.

Figure 2A:
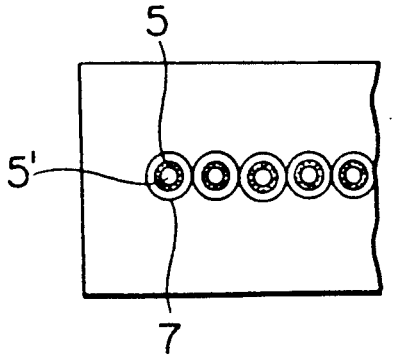
FIG. 2 (*a*) and (*b*) are respectively a part of schematic plan view of one embodiment of a die.
Figure 2B:
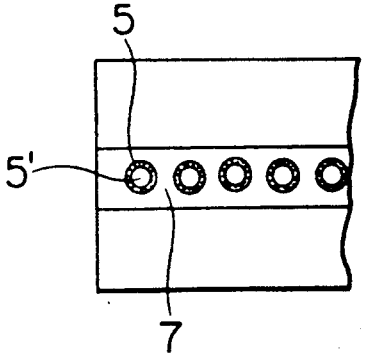

One embodiment of the process for producing a nonwoven fabric of a water-soluble resin such as pullulan according to the present invention will now be illustrated using an apparatus exemplified by FIG. 1 and FIG. 2.

FIG. 1 is a schematic side view of an apparatus for producing a nonwoven fabric according to the present invention. An aqueous solution containing a water-soluble resin such as pullulan or a melt of water-soluble resin plasticized with water is fed from feed pipe 1 to stock tank 2. This starting liquid is extruded from spinning nozzles 5 each having nozzle hole 5' by gear pump 4 driven by motor 3 and at the same time, high pressure air supplied by blower 6 is blown downward from air nozzles 7 as shown in FIG. 2 (*a*) and (*b*) to form water-containing water-soluble resin fiber stream 8. Water-containing, water-soluble resin fiber stream 8 is heated from both the sides thereof by far infrared heater 9 provided in parallel with fiber stream 8 while fiber stream 8 is allowed to fall and is collected on collecting drum 11 of net-type, thereby evaporating and removing the water in the fibers. The thus stretched and dehydrated water-soluble resin fiber stream 10 is allowed to fall, with entangling, on the contact point of two revolving, collecting drums 11 of net-type, compressed therebetween to form nonwoven fabric 12 and wound up by winding-up means 13.

The water-soluble resin nonwoven fabric, in particular, pullulan nonwoven fabric of the present invention, is a nonwoven fabric consisting of fine fibers, which has hitherto not been obtained from the water-soluble resin fibers, in particular, pullulan fibers of the prior art. The nonwoven fabric of the present invention, consisting of superfine fibers of a water-soluble resin, is hydrophilic, hygroscopic, free from electrification, readily soluble in not only warm water but also cold water, edible, non-poisonous, odorless and not stimulative to the skin, and has a soft and good touch feeling. Furthermore, the nonwoven fabric of the present invention does not meet with any problem as to disposal of the waste because it is naturally decomposed in water or in the ground after being used.

Based on these excellent properties, therefore, the nonwoven fabric of the present invention is available for various uses, for example, highly moisture-absorptive sanitary goods such as baby's napkin, women's sanitary napkin and toilet paper, packaging materials of foods or detergents, adsorbents, adhesives and the like.

The following examples are given in order to illustrate the present invention in greater detail without limiting the same.

EXAMPLE 1

Pullulan powder with a mean molecular weight of $20\times10^4$ was dissolved in water to prepare a 20 wt % aqueous solution and subjected to degassing. This solution was fed to an apparatus as shown in FIG. 1 at room temperature (25° C.) and extruded through nozzles of 0.3 mm in diameter under a pressure of 2.0 kg/cm$^2$, while simultaneously air was blown against the extruded fibers at a linear velocity of 400 m/sec from air nozzles to form a fiber stream. The resulting fiber stream was heated from both the sides of the fiber stream by a far infrared heater (wavelength: 2–50 μm) provided at a distance of 30 mm beneath the nozzles at a heater temperature of 400° C. and blown against collecting drums of net type to obtain a nonwoven fabric of pullulan from which the water content was evaporated and removed. The thus resulting nonwoven fabric had a basis weight of 10 g/m$^2$ and a mean fiber diameter of 4 μm. The hygroscopicity thereof at a temperature of 25° C. and a relative humidity of 100% was 130%, 230% and 640% respectively after 30 hours, 120 hours and 340 hours. The nonwoven fabric was instantaneously dissolved in water at room temperature.

EXAMPLE 2

Pullulan powder with a mean molecular weight of $20\times10^4$ was dissolved in water to prepare a 20 wt % aqueous solution of pullulan, to which 30% by weight of apatite powder (grain diameter: 50–300 Å) and 0.18% by weight of a synthetic polycarboxylate (ALON A61-14—commercial name—manufactured by Toa Gosei Chemical Industry Co., Ltd.) as a dispersing agent were added, and then subjected to degassing. This solution was fed to the apparatus used in Example 1 at room temperature (25° C.) and extruded under a pressure of 2.1 kg/cm$^2$, while simultaneously air was blown against the extruded fibers at a linear velocity of 300 m/sec from an air gap to form a fiber stream. The resulting fiber stream was heated from both the sides of the fibers stream by a far infrared heater (wavelength: 2–50 μm) provided at an interval of 20 mm beneath the nozzles at a heater temperature of 500° C. and blown against collecting drums of net-type to obtain a nonwoven fabric of pullulan containing apatite powder, from which the water content was evaporated and removed. The thus resulting nonwoven fabric had a basis weight of 200 g/m$^2$ and a mean fiber diameter of 12 μm.

EXAMPLE 3

The procedure of Example 1 was repeated except changing the extrusion pressure of the aqueous solution of pullulan to 1.4 kg/cm$^2$ from 2.0 kg/cm$^2$, thus obtaining substantially the similar results.

EXAMPLE 4

Polyvinyl alcohol powder having a mean molecular weight of $19\times10^4$ was dissolved in water to prepare a 20 wt % aqueous solution of polyvinyl alcohol and then subjected to degassing. This solution was fed to the apparatus used in Example 1 at room temperature (25° C.) and extruded at a pressure of 2.0 kg/cm$^2$, while simultaneously air was blown against the extruded filaments at a linear velocity of 480 m/sec from the air nozzles to form a fiber stream. The resulting fiber stream was heated from both the sides of the fiber stream by a far infrared heater (wavelength: 2–50 μm) provided at an interval of 30 mm beneath the nozzles at a heater temperature of 450° C. and blown against collecting drums of net-type to obtain a nonwoven fabric of polyvinyl alcohol, from which the water content was evaporated and removed. The thus obtained nonwoven fabric had a basis weight of 30 g/m$^2$ and a mean fiber diameter of 8 μm.

What is claimed is:

1. A process for the production of a non-woven fabric consisting of water-soluble resin fine fibers having a mean fiber diameter of 0.1 to 30μm and base weight of 5 to 500 g/cm$^2$, which comprises extruding an aqueous solution containing a water-soluble resin or a melt of a water-soluble resin or a melt of a water-soluble resin plasticized with water through nozzles, stretching the extruded material to form fibers by a high speed gas flow with a linear velocity of 10 to 1000 m/sec., heating the fibers at a temperature of 80° to 120° C. to evaporate the water in the fibers is at most 10% by weight, and then collecting the fibers by the use of a net-shaped or porous moving belt.

2. The process of claim 1, wherein the water-soluble resin is a water-soluble linear high molecular weight material having at least one group of —OH, —COOH and —$CONH_2$ in molecule.

3. The process of claim 2, wherein the high molecular weight material is at least one member selected from the group consisting of pullulan, polyvinyl alcohol, polyacrylamide, polyacrylic acid, polymethacrylic acid, polyitaconic acid, polyethylene oxide, polyvinylpyrrolidone, polyvinyl methylene ether, hydroxypropyl cellulose, xanthan gum, guar gum, collagen, hydroxyethyl cellulose and mixtures thereof.

4. The process of claim 1, wherein the water-soluble resin has a molecular weight or 2 to $200\times10^4$.

5. The process of claim 1, wherein the water-soluble resin is mixed with at least one member selected from the group consisting of water, sorbitol, maltitol, ethylene glycol, polypropylene glycol and mixtures thereof.

6. The process of claim 1, wherein the water-soluble resin is mixed with at least one member selected from the group consisting of apatite, silica, silicon carbide, silicon nitride, zeolite, activated carbon, alumina, rare earth element compounds and mixtures thereof.

7. The process of claim 1, wherein the water-soluble resin is contained in a proportion of 5 to 95% by weight in the aqueous solution.

* * * * *